US010669826B2

(12) United States Patent
Lacy et al.

(10) Patent No.: US 10,669,826 B2
(45) Date of Patent: Jun. 2, 2020

(54) WELLBORE INJECTION SYSTEM

(71) Applicant: Weatherford U.K. Limited, Leicestershire (GB)

(72) Inventors: Rodger Lacy, Houston, TX (US); Shonagh Mackie, Loughborough (GB); William Murray, Aberdeen (GB)

(73) Assignee: WEATHERFORD U.K. LIMITED (GB)

( * ) Notice: Subject to any disclaimer, the term of this patent is extended or adjusted under 35 U.S.C. 154(b) by 0 days.

(21) Appl. No.: 15/550,532

(22) PCT Filed: Feb. 11, 2016

(86) PCT No.: PCT/GB2016/050325
§ 371 (c)(1),
(2) Date: Aug. 11, 2017

(87) PCT Pub. No.: WO2016/128752
PCT Pub. Date: Aug. 18, 2016

(65) Prior Publication Data

US 2018/0030820 A1 Feb. 1, 2018

(30) Foreign Application Priority Data

Feb. 11, 2015 (GB) ..... 1502272.6

(51) Int. Cl.

| | |
|---|---|
| ***E21B 43/16*** | (2006.01) |
| ***E21B 43/25*** | (2006.01) |
| *E21B 34/10* | (2006.01) |
| *E21B 34/00* | (2006.01) |

(52) U.S. Cl.
CPC ..... *E21B 43/16* (2013.01); *E21B 43/25* (2013.01); *E21B 34/107* (2013.01); *E21B 2034/005* (2013.01)

(58) Field of Classification Search
CPC ..... E21B 43/16; E21B 43/25
See application file for complete search history.

(56) References Cited

U.S. PATENT DOCUMENTS

| | | | |
|---|---|---|---|
| 4,494,608 | A | 1/1985 | Williams et al. |
| 4,691,777 | A | 9/1987 | Williamson |
| 5,718,289 | A | 2/1998 | Schnatzmeyer et al. |
| 2002/0040785 | A1 | 4/2002 | Amani |
| 2006/0021750 | A1 | 2/2006 | Lugtmeier et al. |
| 2009/0205831 | A1 | 8/2009 | Jacob |
| 2009/0277643 | A1 | 11/2009 | Mondelli et al. |

(Continued)

OTHER PUBLICATIONS

PCT International Preliminary Report on Patentability filed in co-pending PCT Application No. PCT/GB2016/050325 dated May 15, 2017, 15 pages.

(Continued)

*Primary Examiner* — David J Bagnell
*Assistant Examiner* — Brandon M Duck
(74) *Attorney, Agent, or Firm* — Blank Rome, LLP

(57) ABSTRACT

A wellbore injection system comprises a tubing hanger mountable within a wellbore tubular, an injection conduit supported by the tubing hanger to extend into the wellbore tubular, and an injection valve mountable within the wellbore tubular and arranged in fluid communication with the injection conduit. The injection valve is removable from the wellbore tubular independently of the tubing hanger and injection conduit.

33 Claims, 3 Drawing Sheets

(56) References Cited

U.S. PATENT DOCUMENTS

| | | | |
|---|---|---|---|
| 2013/0220624 | A1 | 8/2013 | Hill et al. |
| 2015/0361763 | A1 | 12/2015 | Mailand et al. |

OTHER PUBLICATIONS

PCT Search Report and Written Opinion filed in co-pending PCT Application No. PCT/GB2016/050325 dated Jul. 4, 2016, 16 pages.
Great Britain Search Report filed in co-pending GB Application No. GB1502272 dated Feb. 29, 2016, 5 pages.

WELLBORE INJECTION SYSTEM

FIELD

The present invention relates to a wellbore injection system for use in injecting a fluid, such as a treating agent, into a wellbore.

BACKGROUND

Many wellbore operations utilise injection systems which facilitate injection of fluids into wellbore regions. Such injection may be utilised for treating purposes, such as to treat specific regions of a subterranean formation, for example to improve permeability of the geology. Further, such injection may be utilised as a means of assisting the recovery of fluids to surface, for example by modifying the viscosity or effective density of the produced fluid or the like.

Known injection systems may include an injection conduit, sometimes referred to as a capillary conduit, which extends through a wellbore to the required depth. One or more valves are typically included within the system, coupled to the injection conduit, wherein the valves function to check any reverse flow through the conduit back to surface. The injection system is typically suspended within the wellbore via a tubing hanger. However, in some cases if a valve ever needs to be recovered it may be necessary to recover the entire injection conduit, which in some applications might extend for thousands of meters, thus involving a complex and time consuming process.

It has been proposed in the prior art to provide a subsurface safety valve (SSSV) which is operated by fluid pressure applied through an associated wellbore injection system. For example, US 2006/0021750 discloses an injection system which includes a surface controlled subsurface safety valve which incorporates an injection valve, with an injection line suspended directly from the safety valve. The arrangement disclosed in US 2006/0021750 is such that as the injection line is suspended directly from the safety valve, in the event of recovery of the safety valve, for example to replace the injection valve, the injection line would also need to be recovered.

EP 2481882 discloses a subsurface safety valve which incorporates injection capabilities for injecting an additive into a wellbore.

SUMMARY

An aspect or embodiment relates to a wellbore injection system, comprising:

- a tubing hanger mountable within a wellbore tubular;
- an injection conduit supported by the tubing hanger to extend into the wellbore tubular; and
- an injection valve mountable within the wellbore tubular and arranged in fluid communication with the injection conduit;
- wherein the injection valve is removable from the wellbore tubular independently of the tubing hanger and injection conduit.

In use, the injection conduit may extend to a required depth within a wellbore, supported by the tubing hanger, and fluid injected into the wellbore via the injection valve and the injection conduit.

Should retrieval of the injection valve ever be necessary, for example for inspection, maintenance and/or replacement, this may be achieved independently of the tubing hanger and the injection conduit suspended from said tubing hanger. Accordingly, the injection conduit may advantageously remain in place, resulting in a far simpler and less time consuming injection valve retrieval and/or running process.

Terms such as "above" and "below", and other similar terms as used herein should be understood to be relative terms, made with reference to an associated wellbore. For example, when in use an object within a wellbore which is closer to the head of the wellbore (e.g., entry point to the wellbore) may be considered to be above an object which is further from the head of the wellbore, and similarly the object which is further from the head of the wellbore may be considered to be below the object which is closer to the head of the wellbore.

The wellbore injection system may be utilised to facilitate injection of an injection fluid into a wellbore which is configured to support production from a subterranean reservoir, for example production of hydrocarbons such as oil and/or gas.

The wellbore injection system may be for use in injection of an injection fluid which may function as a well treatment fluid. The injection fluid may be mixable with a fluid in a wellbore and/or subsurface reservoir. The injection fluid may also or alternatively be configured to remain separate from a fluid in the wellbore or subsurface reservoir. The injection fluid may be designed to float on and/or sink through a fluid in the wellbore and/or subsurface reservoir. The injection fluid may be designed to change state at least once when in use, for example from a gas to a solid, from a liquid to a foam, or the like. The injection fluid may be, for example, a production enhancement fluid such as a foaming agent.

The injection valve may function to allow the flow of fluid in only one direction therethrough. In such an arrangement the injection valve may be or comprise a one way or check valve. The injection valve may function to permit flow of an injection fluid into a wellbore in an injection direction, to accommodate injection into an associated wellbore, while preventing any reverse flow from the wellbore.

The injection valve may facilitate flow, for example flow in an injection direction, when a minimum pressure differential on opposing sides of the valve is present. In one embodiment such an arrangement may require an injection pressure to exceed a wellbore pressure, to provide additional assurance of minimising risk of reverse flow.

The injection valve may provide a constant injection flow rate therethrough. The injection valve may provide a constant pressure drop.

The injection valve may be mounted within the wellbore tubular via a valve connection arrangement, such as a releasable valve connection arrangement.

The injection valve may be mounted within the wellbore tubular via the tubing hanger. For example, the tubing hanger may support the injection valve. In one embodiment the tubing hanger may be secured or securable to the wellbore tubular, and the injection valve may be secured or securable to the tubing hanger. The injection valve may be releasably secured or securable to the tubing hanger. Such a releasable connection may permit the injection valve to be removed/retrieved independently from the tubing hanger.

The injection valve may be directly secured or securable to the tubing hanger. Alternatively, the injection valve may be indirectly secured or securable to the tubing hanger. In one embodiment the injection valve may be indirectly secured or securable to the tubing hanger via a suitable connection with the injection conduit. In such an arrangement the injection valve may be directly coupled to the injection conduit, wherein the injection conduit is coupled and supported by the tubing hanger. The injection valve may be releasably secured or securable to the injection conduit. Such a releasable connection may permit the injection valve to be removed/retrieved independently from the injection conduit.

The injection valve may be mounted within the wellbore tubular to define a space therebetween. The space may be generally annular. The annular space may accommodate fluid flow therealong, for example produced fluids. Such an arrangement may permit the simultaneous injection into and production from the same wellbore.

The injection system may comprise a valve connection arrangement for facilitating connection between the injection valve and the injection conduit. The valve connection arrangement may provide fluid communication between the injection valve and the injection conduit. The valve connection arrangement may provide a mechanical connection, for example a load transferring mechanical connection, between the injection valve and the injection conduit. The connection arrangement may form part of one or both of the injection valve and the injection conduit. The valve connection arrangement may comprise or define a releasable valve connection arrangement.

The valve connection arrangement may facilitate sealed connection between the injection valve and the injection conduit.

The valve connection arrangement may comprise a stab-in type connector between the injection valve and the injection conduit. Such a stab-in connector may permit connection and optionally disconnection to be achieved by relative axial movement between the injection valve and the injection conduit.

The wellbore injection system may comprise a delivery conduit in fluid communication with the injection valve. The delivery conduit may provide or permit fluid communication from a source of injection fluid to the injection valve, and thus subsequently to the injection conduit. The delivery conduit may be arranged to extend from surface, for example from a topside facility.

In use, the delivery conduit may extend internally of the wellbore tubular.

In use, the delivery conduit may extend externally of the wellbore tubular. For example, in use the delivery conduit may extend along a wellbore annulus defined between the wellbore tubular and a wall of a wellbore within which the wellbore tubular is located. The wall of the wellbore may be defined by a surface of a tubing string, such as a casing string. The wall of the wellbore may be defined by an open hole wellbore.

The delivery conduit may be coupled to a port or port system extending through a wall of the wellbore tubing to facilitate communication of injection fluid to the internally mounted injection valve. The port or port system may also extend through the tubing hanger to facilitate communication of injection fluid to the injection valve.

The wellbore injection system may comprise an injection fluid interface member for facilitating fluid communication between the delivery conduit and the injection valve. The injection fluid interface member may comprise a single component. Alternatively, the injection fluid interface member may comprise multiple components secured or arranged together to define the interface member.

The injection fluid interface member may be mounted within the wellbore tubular via a connection arrangement, such as a releasable connection arrangement.

The injection fluid interface member may be mounted within the wellbore tubular via the tubing hanger. For example, the tubing hanger may support the injection fluid interface member. In one embodiment the tubing hanger may be secured or securable to the wellbore tubular, and the injection fluid interface member may be secured or securable to the tubing hanger. In such an arrangement the tubing hanger may define at least a portion of an injection fluid flow path to facilitate fluid communication between the delivery conduit and the injection fluid interface member. The injection fluid interface member may be releasably secured or securable to the tubing hanger.

The injection fluid interface member may be directly secured or securable to the tubing hanger. Alternatively, the injection fluid interface member may be indirectly secured or securable to the tubing hanger, for example via a further component, such as a subsurface safety valve, further details of which are presented below.

The injection fluid interface member may define a first port, which may be referred to as an injection inlet port, configurable in fluid communication with the delivery conduit.

The first port may be provided in a side wall of the injection fluid interface member. The first port may be directed generally radially. A sealing arrangement may be provided around the first port to provide sealed fluid communication with the delivery conduit. The sealing arrangement may prevent leakage of injection fluid into an internal space of the wellbore tubular.

In some embodiments the injection interface member may comprise a plurality of first ports, each in fluid communication with the delivery conduit.

The injection fluid interface member may define a second port, which may be defined as an injection outlet port, configurable in fluid communication with the injection valve. The second port may be provided in an end face of the injection fluid interface member. The second port may be directed generally axially.

An injection flow path may extend between the first and second ports, such that fluid received from the delivery conduit may be diverted through the interface member to the injection valve.

The injection valve may be secured to the injection fluid interface member. The injection valve and injection fluid interface member may be secured together by any suitable connector, such as a threaded connector, stab-in type connector, interference fit connector, welding, integrally forming or the like.

The injection fluid interface member may comprise a bypass flow path extending therethrough, for example axially therethrough. The bypass flow path may facilitate fluid flow, for example production fluid flow, along the wellbore tubular while the wellbore injection system is mounted therein. The injection flow path and the bypass flow path may be isolated from each other.

The wellbore injection system may comprise a subsurface safety valve mountable within the wellbore tubular. The subsurface safety valve may provide a known wellbore function in terms of providing a selectively openable safety barrier within the wellbore tubular. For example, in a production application the subsurface safety valve may function to only permit production through the wellbore tubular under controlled circumstances, for example achieved by providing controlled and continuous power (such as hydraulic power) to hold the valve open. Interruption in power to the safety valve, whether intended or otherwise, will result in its closure. Furthermore, the safety valve may be configured such that production flow assists to close and hold the valve closed in the event of interruption of power to the valve.

The subsurface safety valve may be mounted above the injection valve.

The subsurface safety valve may be retrievable. The subsurface safety valve may be wireline retrievable, tubing retrievable and/or the like.

The subsurface safety valve may be retrievable independently of the tubing hanger and/or the injection conduit. The subsurface safety valve may be retrievable independently of the injection valve. The subsurface safety valve may be retrievable independently of the injection fluid interface member.

The subsurface safety valve may be mounted within the wellbore tubular via a connection arrangement, such as a releasable connection arrangement.

The subsurface safety valve may be mounted within the wellbore tubular via the tubing hanger. In one embodiment the tubing hanger may be secured or securable to the wellbore tubular, and the subsurface safety valve may be secured or securable to the tubing hanger. The subsurface safety valve may be releasably secured or securable to the tubing hanger.

The subsurface safety may be coupled to the injection fluid interface member. The subsurface safety valve and the interface member may be secured together by any suitable connector, such as a threaded connector, stab-in type connector, interference fit connector, welding, integrally forming or the like. In some embodiments the injection fluid interface member may be connected to the subsurface safety valve in such a manner that the injection fluid interface member is retrievable/installable within the wellbore tubular with the subsurface safety valve. In some embodiments, when the injection valve is coupled to the injection fluid interface member, said valve and interface member may be retrievable/installable with the subsurface safety valve.

The subsurface safety valve may be arranged or arrangeable in fluid communication with a source of fluid power, for example hydraulic power, to facilitate operation of said safety valve. In some embodiments the subsurface safety valve may be in fluid communication with a dedicated source of fluid power.

In some embodiments the subsurface safety valve may be in fluid communication with the injection fluid delivery conduit such that the injection fluid may also function as a source of fluid power for operation of the subsurface safety valve.

In some embodiments the injection fluid delivery conduit may comprise multiple branches, with at least one branch in communication with the injection valve, and at least one other branch in fluid communication with the subsurface safety valve.

In some embodiments the wellbore injection system may comprise an injection fluid diverter arrangement for diverting at least a portion of injection fluid from the delivery conduit to the injection valve, and at least a portion of the injection fluid from the delivery conduit to the subsurface safety valve.

The injection fluid diverter arrangement may comprise an injection fluid chamber or chamber system which receives injection fluid from the delivery conduit. The subsurface safety valve and the injection valve may be in fluid communication with the injection fluid chamber or chamber system.

The injection fluid chamber or chamber system may be at least partially defined by the tubing hanger. The injection fluid chamber or chamber system may be at least partially defined by the wellbore tubular.

In some embodiments the injection fluid chamber or chamber system may be at least partially defined or located between the tubing hanger and the wellbore tubular. The tubing hanger may be secured or securable to the wellbore tubular. The tubing hanger may be releasably secured or securable to the wellbore tubular. The tubing hanger may be retrievable from the wellbore tubular, for example wireline retrievable, tubing retrievable and/or the like. Retrieval of the tubing hanger may facilitate retrieval of the injection conduit.

The tubing hanger may comprise a tubular structure. The tubular structure may be concentrically mounted within the wellbore tubular. One or more other components of the wellbore injection system may be mounted within the tubular structure of the tubing hanger. For example, at least one of the injection valve, injection fluid interface member and the subsurface safety valve may be mounted within the tubular structure of the tubing hanger.

The tubular structure of the tubing hanger may define one or more suitable connector regions to facilitate connection of one or more other components of the wellbore injection system therein.

The tubular structure of the tubing hanger may define one or more suitable sealing faces to facilitate sealed engagement with one or more other components of the wellbore injection system. The tubular structure of the tubing hanger may define or comprise a polished bore receptacle (PBR).

An aspect or embodiment relates to a downhole system, comprising:

a tubing hanger mountable within a wellbore tubular;

an injection conduit supported by the tubing hanger to extend into the wellbore tubular;

an injection valve mountable within the wellbore and arranged in fluid communication with the injection conduit; and a subsurface safety valve mountable within the wellbore tubular;

wherein the injection valve is removable from the wellbore independently of the tubing hanger and injection conduit.

The subsurface safety valve may be operable by an injection fluid, wherein the injection fluid is diverted to both the subsurface safety valve and the injection valve.

An aspect or embodiment relates to a wellbore workover method, comprising retrieving an injection valve from a wellbore tubular by disconnecting the injection valve from an injection conduit, wherein the injection fluid conduit is supported by a tubing hanger.

The workover method may comprise performing a workover on a wellbore injection system according to any other aspect. As such, any description provided in relation to any other aspect can be assumed to provide optional features associated with the workover method.

The workover method may comprise replacing the same or a different injection valve into the wellbore tubular.

An aspect or embodiment relates to a wellbore injection system for mounting within a wellbore, comprising an injection valve mountable within the wellbore, wherein the injection valve includes a releasable connector for facilitating releasable connection with an injection conduit.

An aspect or embodiment relates to a downhole system, comprising:

a subsurface safety valve;

an injection system; and a fluid delivery arrangement for delivering a fluid to the subsurface safety valve and the injection system from a common fluid source.

It should be understood that features defined in relation to one aspect or embodiment may be applied in combination with any other aspect or embodiment.

BRIEF DESCRIPTION OF THE DRAWINGS

These and other aspects will now be described, by way of example only, with reference to the accompanying drawings, in which.

DETAILED DESCRIPTION OF THE DRAWINGS

Figure 1:
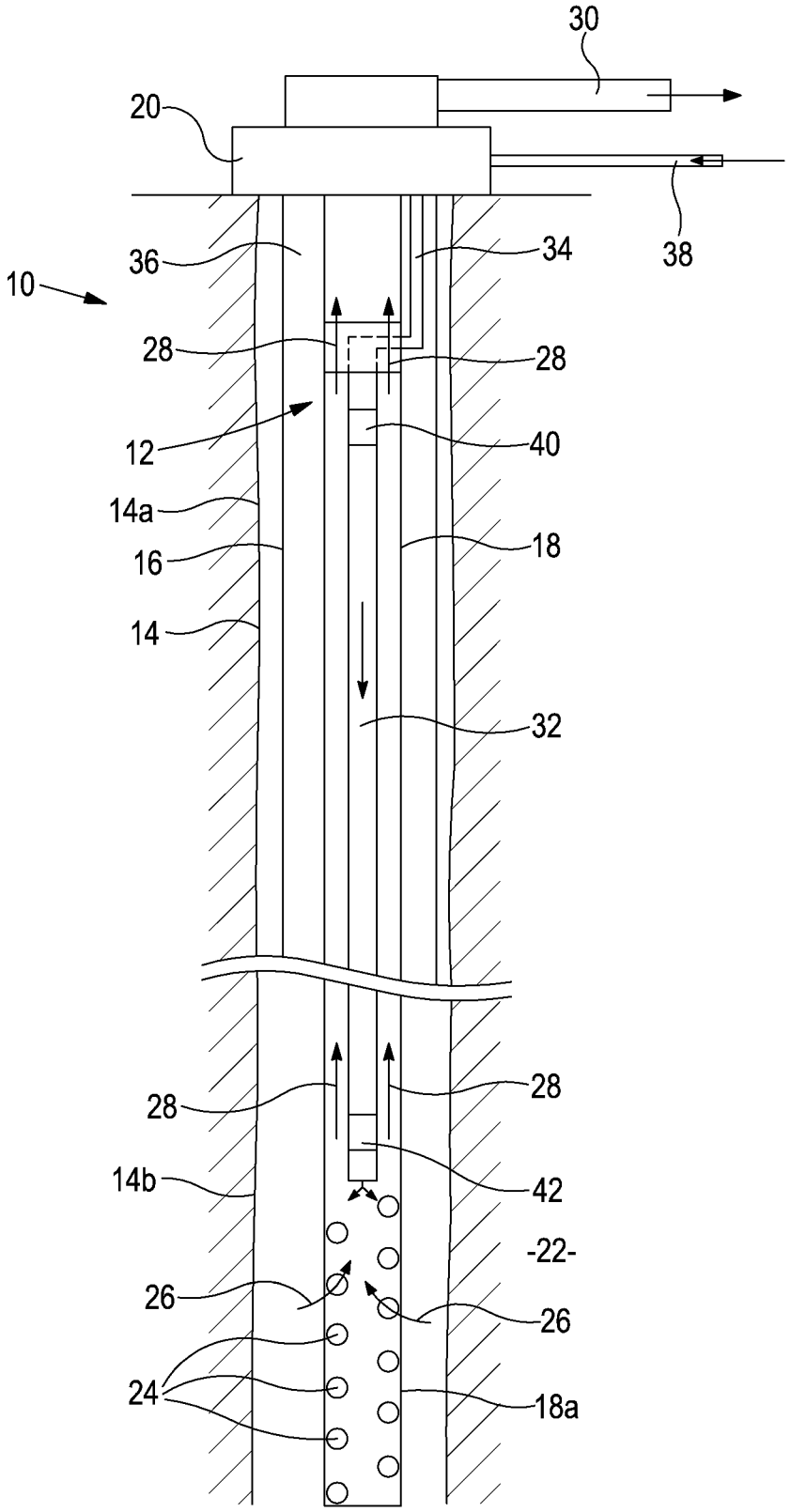
FIG. 1 is a diagrammatic illustration of a production wellbore system, which incorporates an injection system according to aspects of the present invention.

FIG. 1 provides a diagrammatic illustration of a production wellbore system, generally identified by reference numeral 10, which includes a wellbore injection system 12 according to aspects of the present invention. The wellbore system 10 includes a drilled bore 14, wherein in the exemplary embodiment shown an upper bore section 14*a* is lined with casing 16, whereas a lower bore section 14*b* is open hole. A wellbore tubular string, in this case a production tubing string 18 extends from a topside facility, in this case a wellhead 20, to a production zone 22 of a subterranean reservoir. The lower end 18*a* of the production tubing string 18 includes a number of ports or perforations 24 which facilitate inflow of fluids from the production zone 22, in the direction of arrows 26, and subsequent production towards the wellhead 20, illustrated by arrows 28. Produced fluids are then delivered through a topside production conduit 30, for example to a pipeline or storage facility.

The injection system 12 is configured to permit simultaneous injection and production within the same wellbore system 10. The injection system 12 includes an injection conduit, which may be referred to as a capillary conduit 32 which extends between upper and lower regions of the production tubing 18. The capillary conduit is in fluid communication with a delivery conduit 34 which extends along an annulus 36 formed between the production tubing 18 and the wellbore casing 16, The delivering conduit 34 extends to the wellhead 20, and in in fluid communication with an injection fluid supply line 38.

During use, injection fluid is delivered, via the supply line 38, delivery conduit 34 and capillary conduit 32, to be injected into the lower end of the production tubing string 18 generally in the region of the production zone 22. The injection fluid may be selected to provide any suitable effect. However, in the embodiment shown the injection fluid is selected to assist in the production of fluids from the production zone towards the surface. For example, the injection fluid may be arranged to form a foam upon contact with water located at the production zone 22. This foam may facilitate improved production. In particular, such foaming agents may facilitate improved gas production.

The injection system 12 further includes a series of one-way valves to prevent backflow to surface through the injection system. In particular, the injection system 12 includes a first valve arrangement 40 coupled to an upper region of the capillary conduit 32, and a second valve arrangement 42 coupled to a lower region of the capillary conduit 32.

Figure 2:
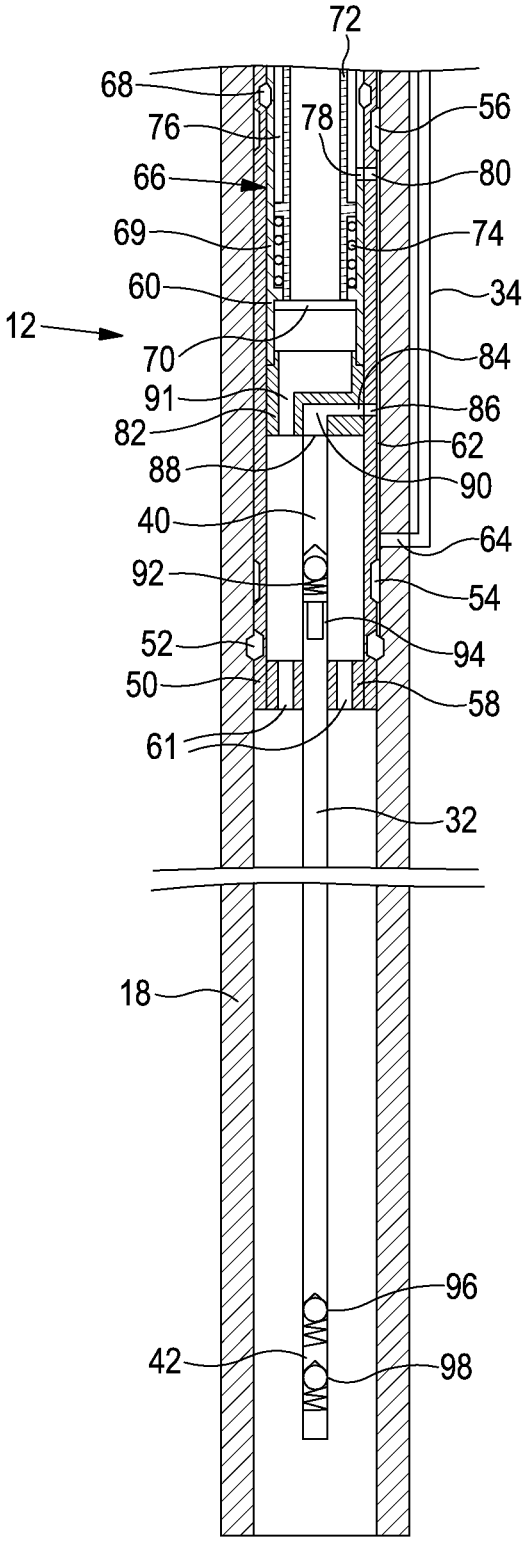
FIG. 2 is a diagrammatic illustration of individual components within the wellbore system of FIG. 1.

A more detailed, yet still diagrammatic, illustration of the injection system 12 is provided in FIG. 2. The injection system 12 includes a tubing hanger 50 which is mechanically secured to the production tubing via a releasable connector system 52, and sealed via seals 54, 56. The tubing hanger 50 includes a tubing interface 58 for engaging and supporting the capillary string 18, while still permitting bypass of production fluids via hanger bypass ports 61.

The tubing hanger includes a tubular structure 60 which is generally concentrically aligned within the production tubing 18, wherein the seals 54, 56 are positioned to provide sealing between the tubular structure 60 and the production tubing 18.

The tubular structure 60 together with the production tubing 18 and seals 54, 56 define a chamber system, wherein the delivery conduit 34 is in fluid communication with the chamber system 62 via a port 64 through the wall of the production tubing 18. As such, injection fluid from the delivery conduit may be delivered into the chamber system 62.

The injection system 12 in the embodiment shown includes a subsurface safety valve, generally identified by reference numeral 66, positioned within the tubular structure 60 of the tubing hanger 50, specifically above the tubing interface 58 of the tubing hanger 60. The subsurface safety valve 66 is mechanically connected to the tubular structure 60 via a suitable releasable connector 68, and as such the subsurface safety valve 66 is mounted within the production tubing string 18 via the tubing hanger 50.

The subsurface safety valve includes a housing 69 and a pivoting flapper 70 mounted relative to the housing 69 and shown in FIG. 2 in a closed position. Although not illustrated, the flapper includes a biasing arrangement, such as a torsion spring, which biases the flapper 70 towards its illustrated closed position. An axially moveable flow tube 72 is mounted within the housing, and a spring member 74 acts between the housing 69 and flow tube 72 to bias the flow tube 72 in an upper direction, to the position shown in FIG. 2, in which the flow tube 72 does not interfere with the flapper 70, allowing the flapper to remain in its illustrated closed position.

A hydraulic chamber 76 is defined between the flow tube 72 and housing 69, wherein the hydraulic chamber 76 is in fluid communication with the chamber system 62 via respective ports 78, 80 formed in the housing 69 of the safety valve 66 and the tubular structure 60 of the tubing hanger 50. As will be described in more detail below, fluid pressure acting in the hydraulic chamber 76 will cause the flow tube 72 to move downwards, compressing the spring 74 and causing the flapper 70 to pivot to an open position. Removal or reduction of fluid pressure will permit the spring 74 to return the flow tube 72 to its original position, allowing the flapper 70 to again close. Furthermore, the flapper will be positively held closed by pressure from below.

A fluid interface member 82 is sealingly mounted within the production tubing string 18, specifically within the tubular structure 60 of the tubing hanger 50, above the tubing interface 58, and is threadedly secured to a lower end of the subsurface safety valve 66, and thus supported by said valve 66. The fluid interface member 82 includes a first port 84 in a side wall thereof which is arranged in fluid communication with the chamber system 62 via port 86 in the tubular structure 60 of the tubing hanger 50. The fluid interface member 82 further includes a second port 88 in an axial end face thereof, with a fluid path 90 extending between the first and second ports.

Figure 3:
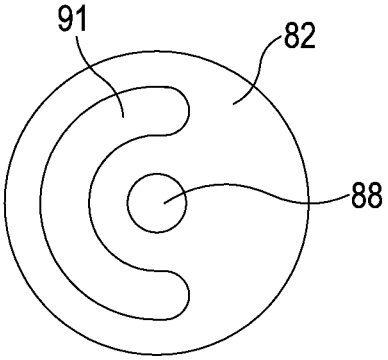
FIG. 3 is a bottom view of an injection fluid interface member first illustrated in FIG. 2.

The fluid interface member 82 includes a bypass flow path 91 arranged to permit production fluids to bypass said interface member. With additional reference to FIG. 3, which shows the form of the interface member 82 from below, the bypass flow path 91 is generally C-shaped, extending around the central second port 88.

The first valve arrangement 40, which may be referred to as a first injection valve arrangement, is secured, for example by a threaded connection, to the interface member 82, such that the first injection valve arrangement 40 is in fluid communication with the second port 88 of the interface member 82.

The first injection valve arrangement 40 includes a one-way check or crack valve 92. Further, the first injection valve arrangement 40 is coupled to the capillary conduit 32 via a releasable stab-in type connection 94.

The second valve arrangement 42, which may be defined as a second injection valve arrangement, is mounted on the lower end of the capillary conduit 32 and in the embodiment shown includes a pair of series mounted one-way check or crack valves 96, 98.

Figure 4:
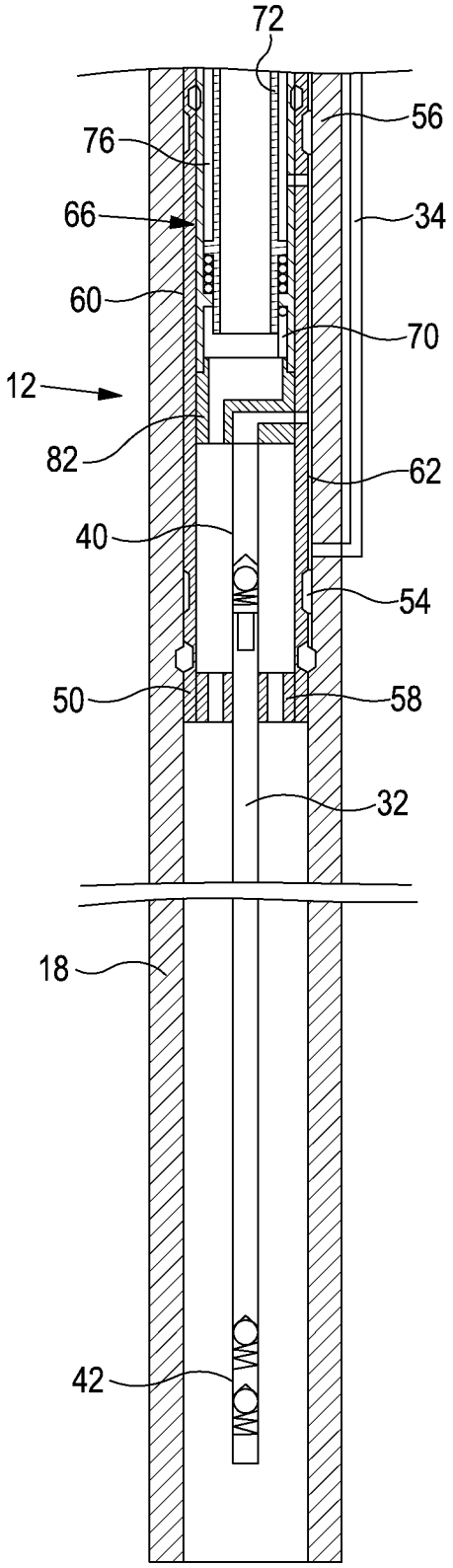
FIG. 4 is a view of the wellbore system of FIG. 2, configured for simultaneous injection and production.

The wellbore injection system 12 is shown in FIG. 2 in a non-injecting and non-producing configuration, which is achieved by zero or insufficient injection fluid pressure provided via the delivery conduit 34. However, when injection and production is required, an operator will increase the injection fluid pressure. In this respect, FIG. 4 illustrates the injection system 12 when configured for simultaneous injection and production.

Specifically, injection fluid will flow, under pressure, into the chamber system 62, with pressure communicated, via ports 78, 80 to the hydraulic chamber 76 of the subsurface safety valve 66, causing the flow tube 72 to move axially downwards and cause the flapper 70 to open, to thus support production.

Also, injection fluid will flow from the chamber system 62, through the fluid interface member 82, through the first injection valve arrangement 40, through the capillary conduit 32, and finally through the second injection valve arrangement 42 before existing into the wellbore. If injection pressure is ever reduced or ceased, whether intentionally or due to some failure, the subsurface safety valve 66 will again close, and the first and second injection valve arrangements 40, 42 will prevent any reverse flow.

In some cases it may be necessary to retrieve components of the injection system 12, for example for inspection, repair and/or replacement. For example, the first injection valve arrangement 40 may in some cases become compromised, for example due to wear of valve seats/seals, blockage by debris or the like. Particular sensitivities to failure modes may be present when high pressures and/or low volumetric flow rates need to be accommodated, for example when a very small valve opening may need to be continuously maintained when in use.

The present invention may be advantageous in that retrieval of the first valve arrangement 40 may be achieved independently of the tubing hanger 50, and thus of the capillary conduit 32. That is, the injection system 12 is arranged to permit the first valve arrangement 40 to be removed/replaced while leaving the capillary conduit 32 in place. Otherwise, as in prior known arrangements, the entire length of the capillary conduit, which can extend for thousands of meters, may need to be retrieved.

Figure 5:
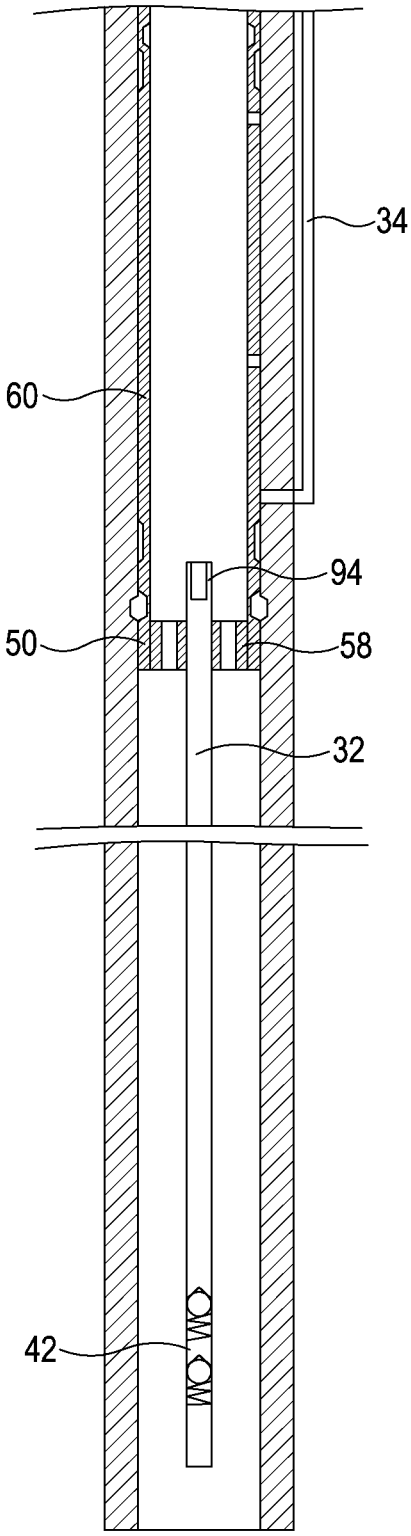
FIG. 5 is a view of the wellbore system of FIG. 2, illustrating a tubing hanger and capillary string remaining in place within the wellbore following removal of a safety valve and injection valve.

In this respect, if the first valve arrangement 40, or indeed the subsurface safety valve 66 or fluid interface member 82 need to be retrieved, this may be achieved by use of an appropriate retrieval tool or system, as known in the art, for example wireline and/or tubing retrieval systems. The retrieval system may latch or otherwise connect to the subsurface safety valve, and be operated to release this from the tubing hanger 50, permitting the safety valve 66 and connected interface member 82 and first valve arrangement 40 to be retrieved to surface, with the first injection valve arrangement 40 being released from the capillary conduit 32 at the releasable stab-in type connection 94. This will leave the tubing hanger 50 and capillary conduit 32 in place, as illustrated in FIG. 5.

Nevertheless, should the tubing hanger and/or capillary conduit 32 ever need to be retrieved, this of course is still possible by suitable retrieval of the tubing hanger, for example by wireline, coiled tubing retrieval or the like.

It should be understood that the embodiments described above are merely exemplary and that various modifications may be made thereto without departing from the scope of the present invention. For example, in the illustrated embodiment the tubing hanger includes a tubular structure within which other components of the injection system are located. However, in other embodiments one or more components may be directly located within the wellbore tubular (e.g., production tubing).

Further, in other embodiments the subsurface safety valve may not be present. Also, in some cases the injection system may be utilised in a wellbore which does not support simultaneous production, for example in an exclusive injection well.

The invention claimed is:

1. A wellbore injection system, comprising:

a tubing hanger mountable within a wellbore tubular;

an injection conduit supported by the tubing hanger to extend into the wellbore tubular;

an injection valve mountable within the wellbore tubular and arranged in fluid communication with the injection conduit;

a delivery conduit in fluid communication with the injection valve, the delivery conduit providing fluid communication from a source of injection fluid to the injection conduit; and an injection fluid interface member for facilitating fluid communication between the delivery conduit and the injection valve;

wherein the injection valve is removable from the wellbore tubular independently of the tubing hanger and injection conduit, and wherein the injection fluid interface member is releasably secured to the tubing hanger.

2. The wellbore injection system according to claim 1, wherein the injection valve permits the flow of fluid in only one direction therethrough.

3. The wellbore injection system according to claim 1, wherein the injection valve is mounted within the wellbore tubular via a releasable valve connection arrangement.

4. The wellbore injection system according to claim 1, wherein the injection valve is releasably mounted within the wellbore tubular via the tubing hanger.

5. The wellbore injection system according to claim 1, wherein the injection valve is releasably secured or securable to the tubing hanger via a connection with the injection conduit.

6. The wellbore injection system according to claim 1, wherein the injection valve is mounted within the wellbore tubular to define a space therebetween for accommodating fluid flow therealong.

7. The wellbore injection system according to claim 1, comprising a valve connection arrangement for facilitating connection between the injection valve and the injection conduit.

8. The wellbore injection system according to claim 1, wherein the delivery conduit extends from surface.

9. The wellbore injection system according to claim 1, wherein in use, the delivery conduit extends externally of the wellbore tubular.

10. The wellbore injection system according to claim 1, wherein the delivery conduit is coupled to a port or port system extending through a wall of the wellbore tubing to facilitate communication of injection fluid to the internally mounted injection valve.

11. The wellbore injection system according to claim 10, wherein the port or port system extends through the tubing hanger to facilitate communication of injection fluid to the injection valve.

12. The wellbore injection system according to claim 1, wherein the injection fluid interface member is mounted within the wellbore tubular via a releasable connection arrangement.

13. The wellbore injection system according to claim 1, wherein the injection fluid interface member is mounted within the wellbore tubular via the tubing hanger.

14. The wellbore injection system according to claim 1, wherein the injection fluid interface member defines a first port configurable in fluid communication with the delivery conduit.

15. The wellbore injection system according to claim 14, wherein the injection fluid interface member defines a second port configurable in fluid communication with the injection valve.

16. The wellbore injection system according to claim 14, wherein an injection flow path extends between the first and second ports, such that fluid received from the delivery conduit may be diverted through the interface member to the injection valve.

17. The wellbore injection system according to claim 1, wherein the injection valve is secured to the injection fluid interface member.

18. The wellbore injection system according to claim 1, wherein the injection fluid interface member comprises a bypass flow path extending therethrough for facilitating fluid flow along the wellbore tubular while the wellbore injection system is mounted therein.

19. The wellbore injection system according to claim 1, comprising a subsurface safety valve mountable within the wellbore tubular.

20. The wellbore injection system according to claim 19, wherein the subsurface safety valve is mounted above the injection valve.

21. The wellbore injection system according to claim 19, wherein the subsurface safety valve is retrievable independently of the tubing hanger and/or the injection conduit.

22. The wellbore injection system according to claim 19, wherein the subsurface safety valve is retrievable independently of the injection valve.

23. The wellbore injection system according to claim 19, wherein the subsurface safety valve is retrievable independently of the injection fluid interface member.

24. The wellbore injection system according to claim 19, wherein the subsurface safety valve is mounted within the wellbore tubular via a releasable connection arrangement.

25. The wellbore injection system according to claim 19, wherein the subsurface safety valve is mounted within the wellbore tubular via the tubing hanger.

26. The wellbore injection system according to claim 19, wherein the subsurface safety is coupled to the injection fluid interface member.

27. The wellbore injection system according to claim 19, wherein the subsurface safety valve is in fluid communication with the delivery conduit such that injection fluid also functions as a source of fluid power for operation of the subsurface safety valve.

28. The wellbore injection system according to claim 27, wherein the injection fluid delivery conduit comprises multiple branches, with at least one branch in communication with the injection valve, and at least one other branch in fluid communication with the subsurface safety valve.

29. The wellbore injection system according to claim 27, comprising an injection fluid diverter arrangement for diverting at least a portion of injection fluid from the delivery conduit to the injection valve, and at least a portion of the injection fluid from the delivery conduit to the subsurface safety valve.

30. The wellbore injection system according to claim 29, wherein the injection fluid diverter arrangement comprises an injection fluid chamber or chamber system which receives injection fluid from the delivery conduit, wherein the subsurface safety valve and the injection valve are in fluid communication with the injection fluid chamber or chamber system.

31. The wellbore injection system according to claim 30, wherein the injection fluid chamber or chamber system is at least partially defined by the tubing hanger.

32. A downhole system, comprising:

a tubing hanger mountable within a wellbore tubular;

an injection conduit supported by the tubing hanger to extend into the wellbore tubular;

an injection valve mountable within the wellbore and arranged in fluid communication with the injection conduit;

a delivery conduit in fluid communication with the injection valve, the delivery conduit providing fluid communication from a source of injection fluid to the injection conduit; and an injection fluid interface member for facilitating fluid communication between the delivery conduit and the injection valve;

a subsurface safety valve mountable within the wellbore tubular;

wherein the injection valve is removable from the wellbore independently of the tubing hanger and injection conduit, and wherein the injection fluid interface member is releasably secured to the tubing hanger.

33. A wellbore workover method, comprising retrieving an injection valve of a system according to claim 1 from a wellbore tubular by disconnecting the injection valve from an injection conduit, wherein the injection fluid conduit is supported by a tubing hanger.

* * * * *